US007749104B2

(12) United States Patent
Brekke et al.

(10) Patent No.: US 7,749,104 B2
(45) Date of Patent: Jul. 6, 2010

(54) GOLF CLUB HEAD

(75) Inventors: Dustin J. Brekke, Westminster, CA (US); Robert J. Horacek, Hermosa Beach, CA (US)

(73) Assignee: SRI Sports Limited, Kobe-shi (JP)

( * ) Notice: Subject to any disclaimer, the term of this patent is extended or adjusted under 35 U.S.C. 154(b) by 37 days.

(21) Appl. No.: 12/330,202

(22) Filed: Dec. 8, 2008

(65) Prior Publication Data

US 2009/0088270 A1 Apr. 2, 2009

(51) Int. Cl.
*A63B 53/04* (2006.01)

(52) U.S. Cl. ..... 473/345; 473/346

(58) Field of Classification Search ..... 473/324–350, 473/287–292

See application file for complete search history.

(56) References Cited

U.S. PATENT DOCUMENTS

| | | | | |
|---|---|---|---|---|
| 5,067,715 | A | 11/1991 | Schmidt et al. | |
| 5,163,682 | A | 11/1992 | Schmidt et al. | |
| 5,180,166 | A | 1/1993 | Schmidt et al. | |
| 5,318,300 | A | 6/1994 | Schmidt et al. | |
| 5,380,010 | A | 1/1995 | Werner et al. | |
| 5,419,559 | A | 5/1995 | Melanson et al. | |
| 5,451,058 | A | 9/1995 | Price et al. | |
| 5,474,296 | A | 12/1995 | Schmidt et al. | |
| 5,649,872 | A | 7/1997 | Antonious | |
| 5,669,829 | A * | 9/1997 | Lin | 473/346 |
| 5,851,159 | A | 12/1998 | Burrows | |
| 5,941,782 | A * | 8/1999 | Cook | 473/346 |
| 5,997,415 | A | 12/1999 | Wood | |
| 6,162,133 | A | 12/2000 | Peterson | |
| 6,309,311 | B1 | 10/2001 | Lu | |
| 6,422,951 | B1 | 7/2002 | Burrows | |
| 6,595,871 | B2 | 7/2003 | Sano | |
| 6,672,975 | B1 * | 1/2004 | Galloway | 473/342 |
| 6,878,073 | B2 | 4/2005 | Takeda | |
| 6,974,393 | B2 | 12/2005 | Caldwell et al. | |
| 7,041,189 | B2 | 5/2006 | Caldwell et al. | |
| 7,056,228 | B2 | 6/2006 | Beach et al. | |
| 7,056,229 | B2 | 6/2006 | Chen | |
| 7,059,973 | B2 | 6/2006 | Erickson et al. | |

(Continued)

FOREIGN PATENT DOCUMENTS

| | | |
|---|---|---|
| JP | U-51-051860 | 4/1976 |

(Continued)

*Primary Examiner*—Sebastiano Passaniti
(74) *Attorney, Agent, or Firm*—Oliff & Berridge, PLC

(57) ABSTRACT

A golf club head according to one or more aspects of the present invention may generally include a strike face, a top portion, a bottom portion, a heel portion, a toe portion, and a hosel having a central axis located in an first imaginary vertical plane. A discrete, at least partially curvilinear stiffening element, having generally vertical side surfaces, may be coupled to at least one of the top portion and the bottom portion to improve the dynamic-excitation response of the club head. Preferably, the stiffening element is oriented such that an imaginary horizontal line intersects at least one of the vertical surfaces at least two points. Additionally, the stiffening element may have at least two inflection points located along a non-linear path characterized by the vertical projection of one of the side surfaces onto at least one of the bottom portion and the top portion of the club head.

21 Claims, 20 Drawing Sheets

U.S. PATENT DOCUMENTS

| | | | | |
|---|---|---|---|---|
| 7,066,835 | B2 | 6/2006 | Evans et al. | |
| 7,108,614 | B2 | 9/2006 | Lo | |
| 7,128,660 | B2 | 10/2006 | Gillig | |
| 7,247,103 | B2 | 7/2007 | Beach et al. | |
| 7,250,007 | B2 | 7/2007 | Lu | |
| 7,258,624 | B2 | 8/2007 | Kobayashi | |
| 8,630,132 | | 8/2007 | Erickson et al. | |
| 7,273,419 | B2 | 9/2007 | Evans et al. | |
| 7,361,100 | B1 | 4/2008 | Morales et al. | |
| 7,445,564 | B2 * | 11/2008 | Kusumoto | 473/346 |
| 2003/0171162 | A1 | 9/2003 | Park | |
| 2003/0190975 | A1 * | 10/2003 | Fagot | 473/346 |
| 2004/0087388 | A1 | 5/2004 | Beach et al. | |
| 2005/0119070 | A1 | 6/2005 | Kumamoto | |
| 2006/0052181 | A1 | 3/2006 | Serrano et al. | |
| 2006/0172818 | A1 | 8/2006 | Yamamoto | |
| 2006/0270490 | A1 | 11/2006 | Lo | |
| 2007/0032312 | A1 | 2/2007 | Serrano et al. | |
| 2007/0032313 | A1 | 2/2007 | Serrano et al. | |
| 2007/0155533 | A1 | 7/2007 | Solheim et al. | |
| 2007/0155539 | A1 | 7/2007 | Schweigert et al. | |
| 2007/0225086 | A1 | 9/2007 | Lin | |
| 2007/0281798 | A1 | 12/2007 | Erickson et al. | |
| 2008/0045356 | A1 | 2/2008 | Lin et al. | |
| 2008/0051216 | A1 | 2/2008 | Evans et al. | |
| 2008/0051219 | A1 | 2/2008 | Erickson et al. | |
| 2008/0176673 | A1 | 7/2008 | Morales et al. | |
| 2010/0029402 | A1 * | 2/2010 | Noble et al. | 473/291 |

FOREIGN PATENT DOCUMENTS

| | | |
|---|---|---|
| JP | U-60-092559 | 6/1985 |
| JP | A-63-264085 | 10/1988 |
| JP | U-05-084353 | 11/1993 |
| JP | A-06-285190 | 10/1994 |
| JP | A-07-124276 | 5/1995 |
| JP | A-11-299937 | 11/1999 |
| JP | A-2003-144591 | 5/2003 |
| JP | A-2006-513805 | 4/2006 |
| JP | A-2008-086337 | 4/2008 |

* cited by examiner

GOLF CLUB HEAD

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Wood-type golf club heads generally weigh between about 150 grams and about 250 grams. A portion of this mass is dedicated to maintaining the structural integrity of the club head. The remaining mass, commonly referred to as "discretionary" mass, may be strategically distributed throughout the club head to improve the inertial characteristics of the head.

Recent increases in club-head size has caused the effective hitting area of the head (the "sweet" area of the strike face) to grow as well. Larger head size also necessitated a reduction in overall wall thickness to maintain head weight within a usable range. It is generally known to those skilled in the art that the dynamic-excitation response of a club head at ball impact may be adversely affected by increased wall compliance associated with thin-wall technology.

Typically, high-compliance regions of the club head are stabilized with, e.g., rib-like structures or stiffening elements. However, each high-compliance region generally requires a discrete stiffening structure, thus significantly reducing the available discretionary mass of the club head.

SUMMARY

The present invention, in one or more aspects thereof, may advantageously comprise a golf club head having enhanced forgiveness on mishit shots, improved dynamic-excitation response, and reduced hook/slice tendencies.

In one example, a golf club head, according to one or more aspects of the present invention, may include a strike face, a toe portion, a heel portion, as well as a top portion and a bottom portion coupled to the strike face. The club head may further include a discrete, at least partially curvilinear stiffening element, coupled to at least one of the top portion and the bottom portion. Preferably, the stiffening element may have at least two inflection points and at least two generally vertical surfaces.

In another example, a golf club head, according to one or more aspects of the present invention, may include a strike face, a top portion coupled to the strike face, a hosel associated with the top portion, and a bottom portion coupled to the strike face. The hosel may have a central axis located in a first imaginary vertical plane. The club head may further include a discrete, at least partially curvilinear stiffening element, coupled to at least one of the top portion and the bottom portion. Preferably, the stiffening element may include at least two generally vertical surfaces. An imaginary horizontal line may be disposed in a second imaginary vertical plane, substantially parallel to the first imaginary vertical plane, and may intersect one of the vertical surfaces at at least three discrete points.

In yet another example, a golf club head, according to one or more aspects of the present invention, may include a strike face, a heel portion, a toe portion, a top portion coupled to the strike face, a hosel associated with the top portion, and a bottom portion coupled to the strike face. The hosel may have a central axis disposed in a first imaginary vertical plane. The club head may further include a discrete, at least partially curvilinear stiffening element, coupled to at least one of the top portion and the bottom portion. Preferably, the stiffening element may include at least one inflection point and at least two generally vertical surfaces. An imaginary horizontal line may be disposed in a second imaginary vertical plane, substantially perpendicular to the first imaginary vertical plane, and may intersect one of the vertical surfaces at at least two discrete points.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein.

DETAILED DESCRIPTION

Figure 1:
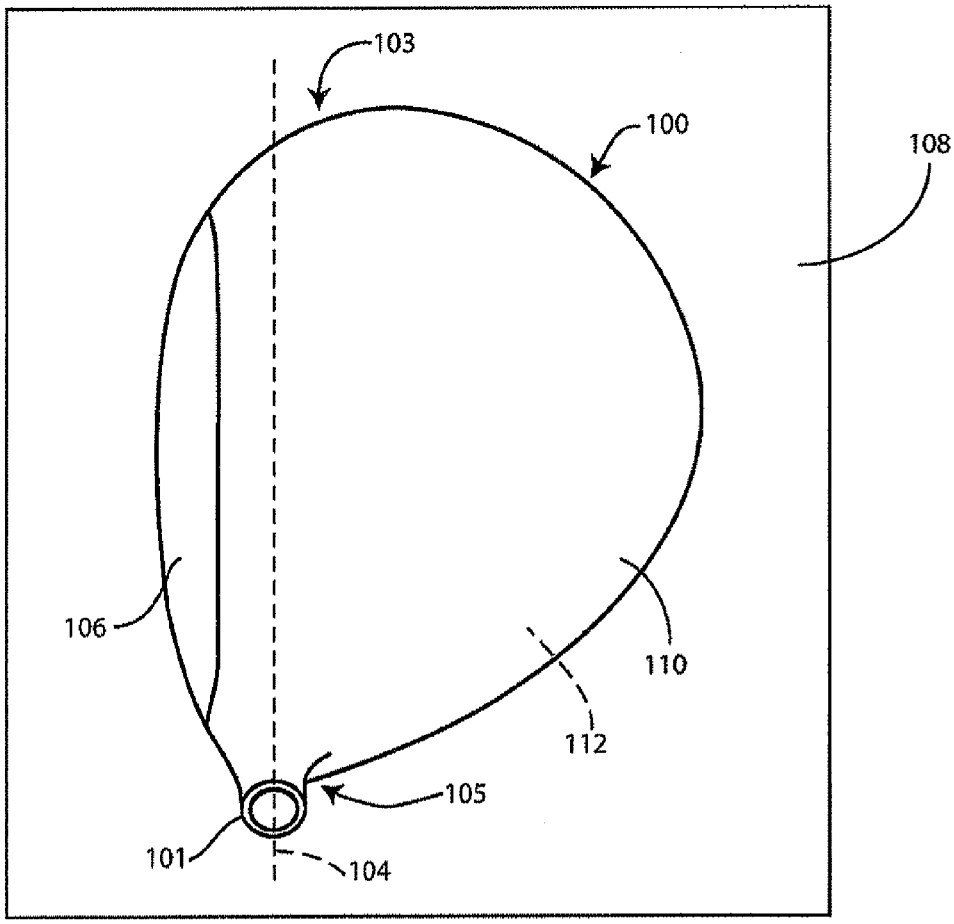
FIG. 1 is a top plan view of an exemplary golf club head according to one or more aspects of the present invention.
Figure 1A:
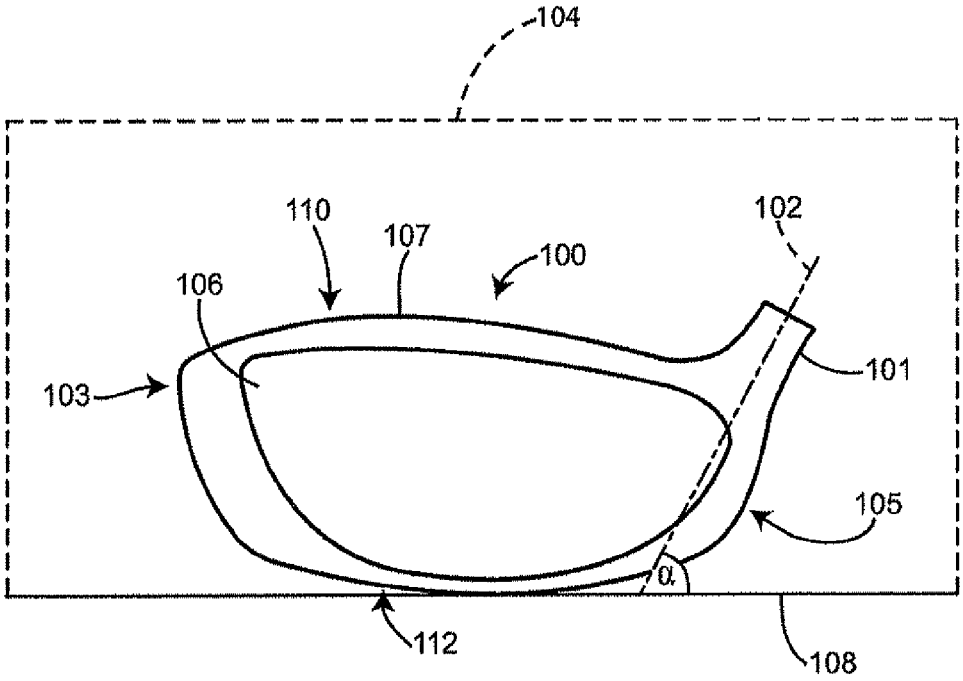
FIG. 1A is a front elevational view of the golf club head of FIG. 1.

Referring to FIGS. 1 and 1A, a club head 100, according to one or more aspects of the present invention, may generally comprise a strike face 106 and a shell 107 having a top portion 110, and a bottom portion 112. The strike face 106 may be integral with the shell 107 or may be joined thereto, e.g., by welding, brazing, or adhesive bonding. A hosel 101, having a central axis 102, may extend from the top portion 110 for receiving a shaft. The club head 100 incorporates a heel portion 105, located proximate the hosel 101, and a toe portion 103, located opposite the heel portion 105. Suitable materials for fabricating the golf club head may include, e.g., stainless steel, 6-4 titanium alloy, 10-2-3 Beta-C titanium alloy, 6-22-22 titanium alloy, or the like.

Referring again to FIGS. 1 and 1A, the club head 100 is oriented in a "reference position", which denotes a position of the club head 100 where the hosel centerline 102 is in an imaginary vertical plane 104 and is oriented at a lie angle $\alpha$ of substantially 60° with respect to a ground plane 108. The plane 104 is substantially parallel to the strike face 106. Unless otherwise indicated, all parameters herein are specified with the club head in the reference position.

Figure 1B:
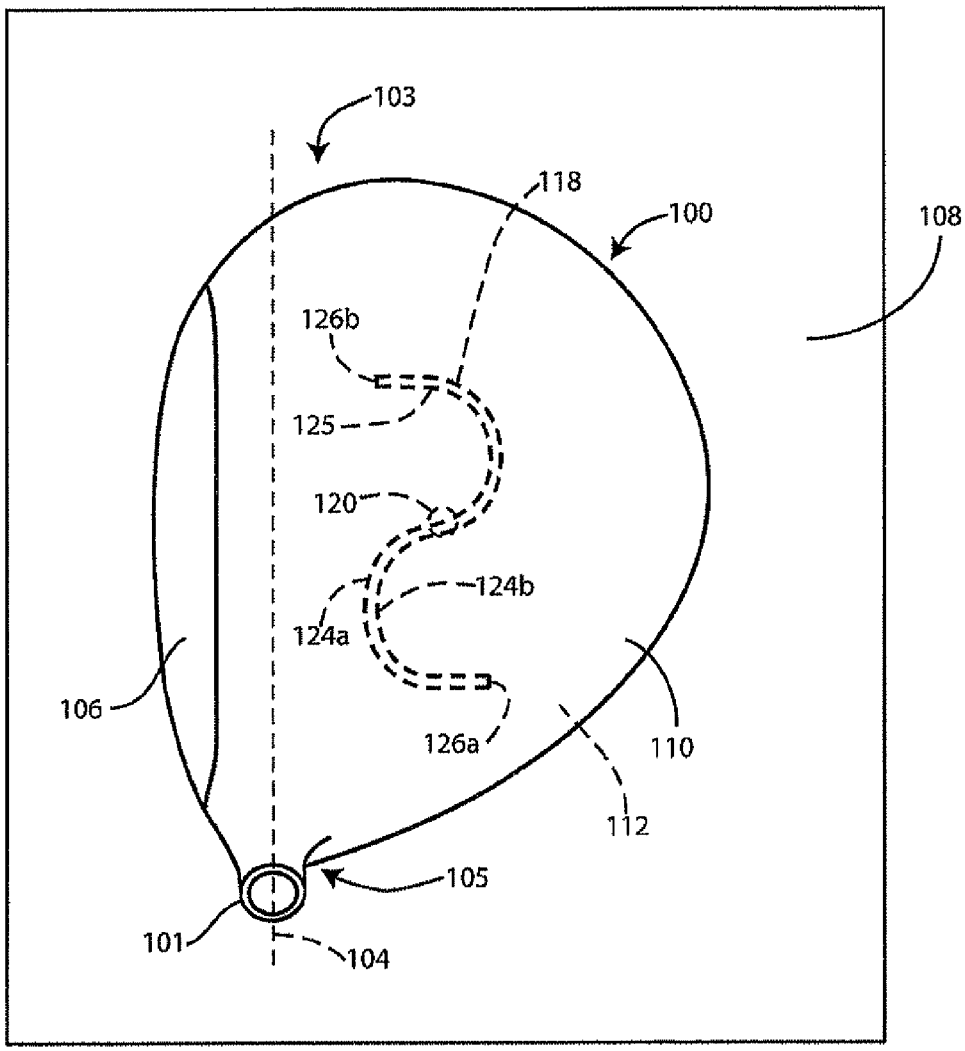
FIG. 1B is a top plan view of the golf club head of FIG. 1.

Referring to FIG. 1B, the golf club head 100 may further include a discrete stiffening element 118, located in the interior cavity of the club head. The stiffening element 118 may be formed from metallic and/or non-metallic materials, may be made integral or attached to head 100, and may be produced, e.g., via a casting, forging, powdered-metal forming, or an injection molding process. Examples of materials suitable for fabricating the stiffening element 118 may include stainless steel, 6-4 titanium alloy, 10-2-3 Beta-C titanium alloy, 6-22-22 titanium alloy, composite materials, (e.g., carbon-fiber reinforced plastic) and thermoplastic materials, (e.g., polyurethanes, polyesters, polyamides, and ionomers).

The stiffening element 118 may have two generally vertical side surfaces 124*a* and 124*b* and two end surfaces 126*a* and 126*b*. To improve the dynamic-excitation response of the club head at ball impact, the two side surfaces 124*a* and 124*b* may be at least partially curvilinear to reinforce unfavorably resonant areas of the head, located generally along a non-linear path 125 that is characterized by the vertical projection of the side surface 124*a* onto at least one of the bottom portion 112 and the top portion 110. Ameliorated dynamic-excitation response may increase player confidence and, accordingly, promote greater swing speeds and associated increases in carry distance. The side surface 124*a* may have at least one inflection point 120, located along the non-linear path 125 and may be parallel, i.e., extending in the same direction, equidistant at all points, and never converging or diverging, with the side surface 124*b*.

Figure 1C:
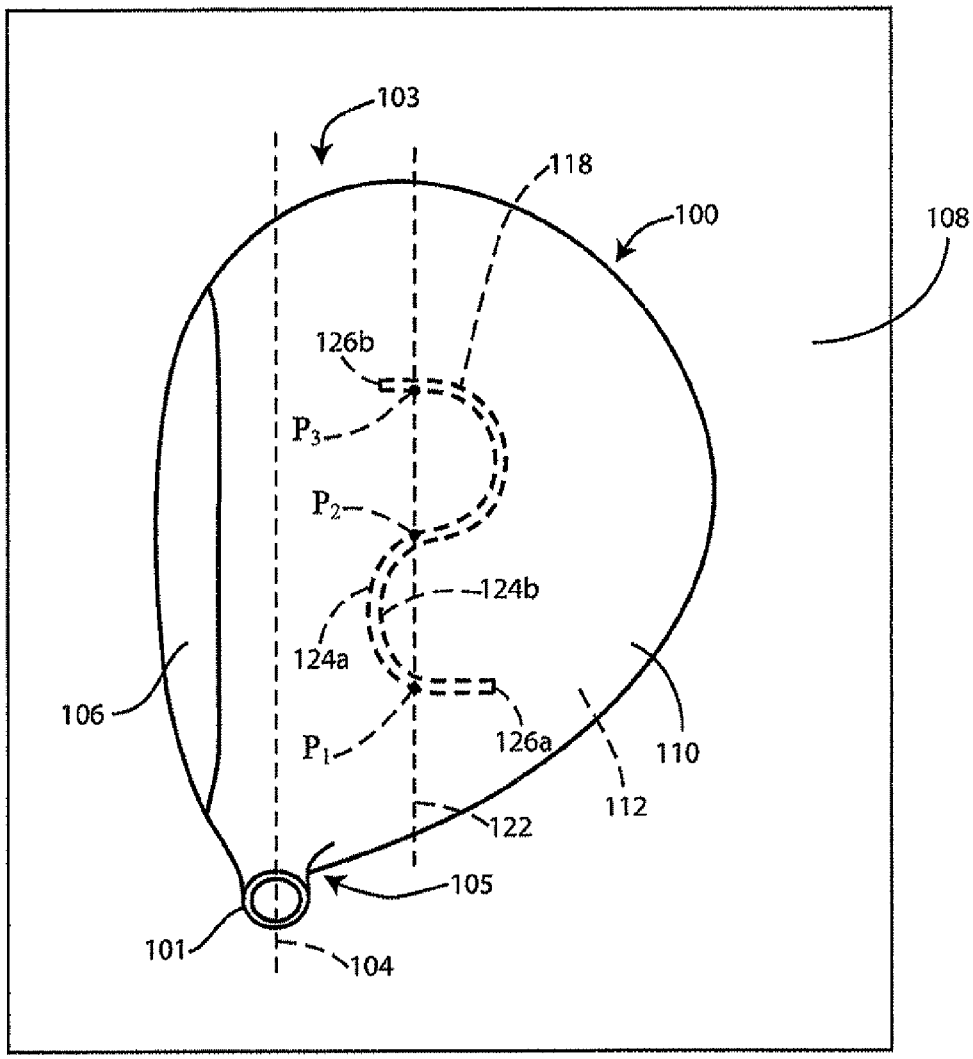
FIG. 1C is a top plan view of the golf club head of FIG. 1.
Figure 1D:
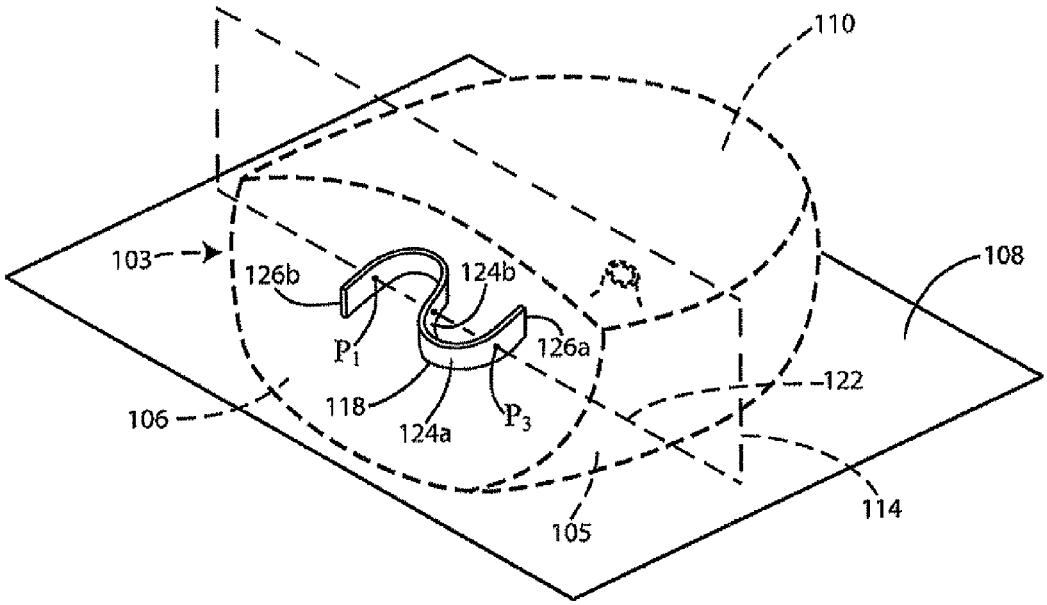
FIG. 1D is a front heel-side perspective view of the golf club head of FIG. 1.

Referring to FIGS. 1C and 1D, the stiffening element 118 may be oriented in such that an imaginary horizontal line 122, located in an imaginary vertical plane 114 (FIG. 1D) that is substantially parallel to the plane 104, intersects one of the side surfaces 124*a* and 124*b* at at least two points or, more preferably, at at least three points. These intersection points are discrete due to the non-planar shape of the stiffening element 118. For example, the horizontal line 122 may intersect the side surface 124*a* at points $P_1$, $P_2$, and $P_3$ (FIG. 1C). The end surfaces 126*a* and 126*b* may be located proximate the heel portion 105 and the toe portion 103, respectively.

Figure 1E:
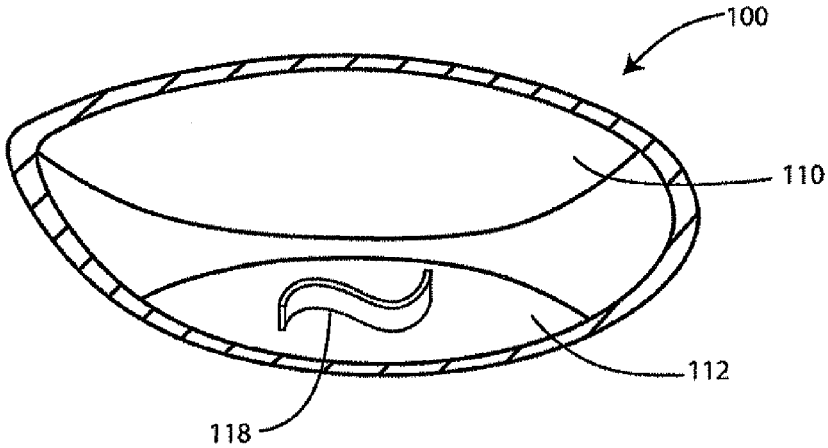
FIG. 1E is a front cross-sectional view of the golf club head of FIG. 1.
Figure 2:
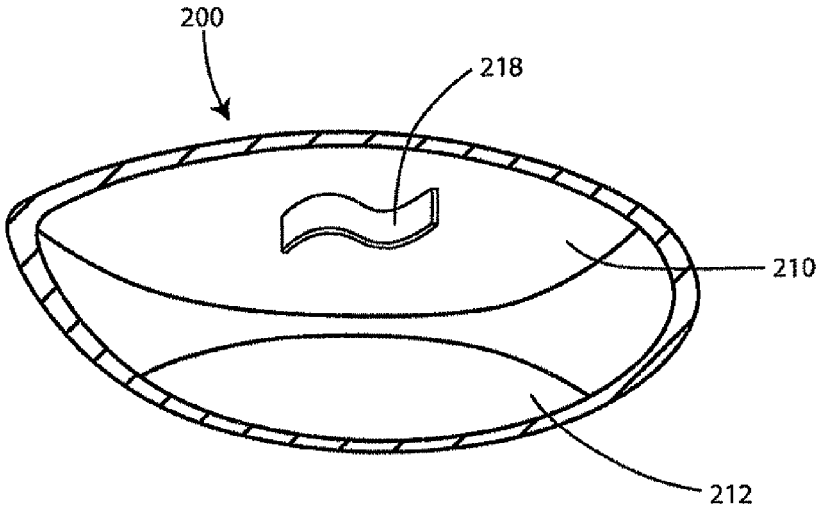
FIG. 2 is a front cross-sectional view of an exemplary golf club head according to one or more aspects of the present invention.
Figure 3:
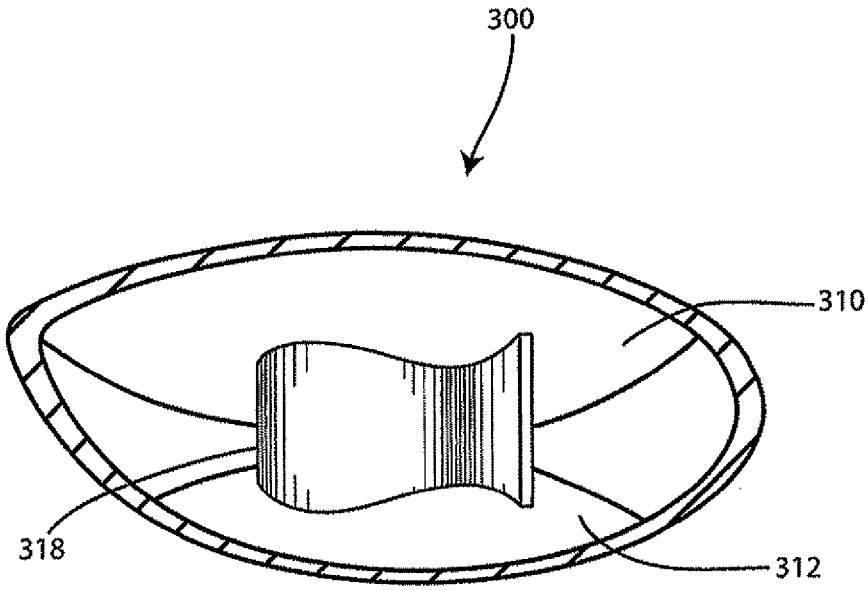
FIG. 3 is a front cross-sectional view of an exemplary golf club head according to one or more aspects of the present invention.

The stiffening element 118 of the club head, according to one or more aspects of the present invention, may be integral with or attached to at least one of the top portion and the bottom portion of the head. For example, as shown in FIG. 1E, the club head 100 may have a plurality of unfavorably resonant high-compliance areas located primarily in the bottom portion 112. Thus, the stiffening element 118 may be disposed entirely in the bottom portion 112 to reinforce these regions. Alternatively, a club head 200, shown in FIG. 2, may have a plurality of unfavourably resonant areas located primarily in a top portion 210. Accordingly, a discrete, at least partially curvilinear stiffening element 218 may be disposed entirely in the top portion 210. In another example of the invention (FIG. 3), a club head 300 may have unfavorably resonant areas in both a top portion 310 and a bottom portion 312, with a discrete, at least partially curvilinear stiffening element 318 coupled to the top portion 310 and the bottom portion 312. Alternatively, the club head 300 may be provided with plural stiffening elements, configured as described with reference to FIGS. 1E and 2, above.

Referring to FIG, 4, a golf club head 400, according to one or more aspects of the present invention, may generally include a strike face 406, a top portion 410, a bottom portion 412, a heel portion 405, a toe portion 403, and a hosel 401 having a central axis (not shown) located in an imaginary vertical plane 404. The club head 400 may further include a discrete stiffening element 418 to improve the dynamic-excitation response of the club head. The stiffening element may incorporate two generally vertical side surfaces 424*a* and 424*b* and two end surfaces 426*a* and 426*b* to improve the dynamic-excitation response of the club head. The two side surfaces 424*a* and 424*b* may be at least partially curvilinear to reinforce unfavourably resonant areas of the club head located generally along a non-linear path 425 that is characterized by the vertical projection of the side surface 424*a* onto at least one of the bottom portion 412 and the top portion 410.

Figure 4:
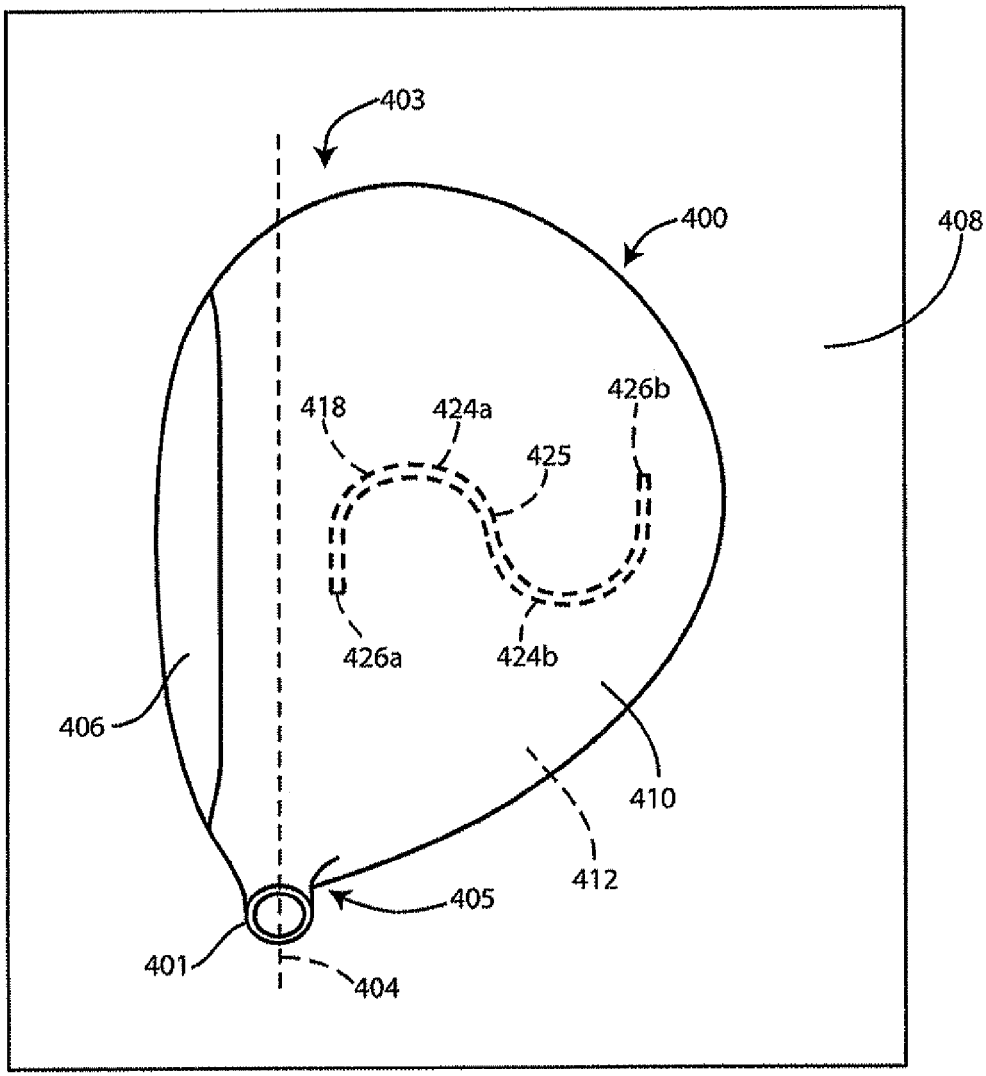
FIG. 4 is a top plan view of an exemplary golf club head according to one or more aspects of the present invention.
Figure 4A:
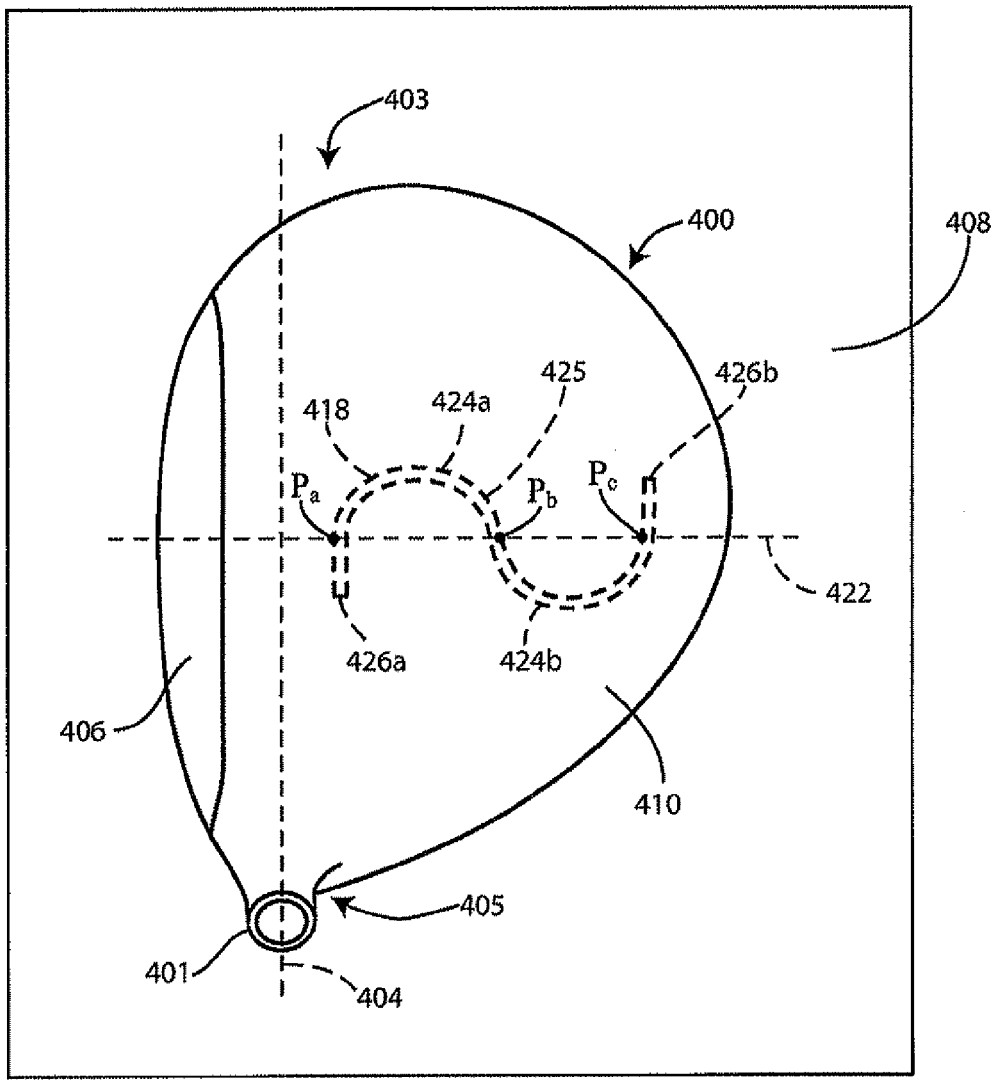
FIG. 4A is a top plan view of the golf club head of FIG. 4.
Figure 4B:
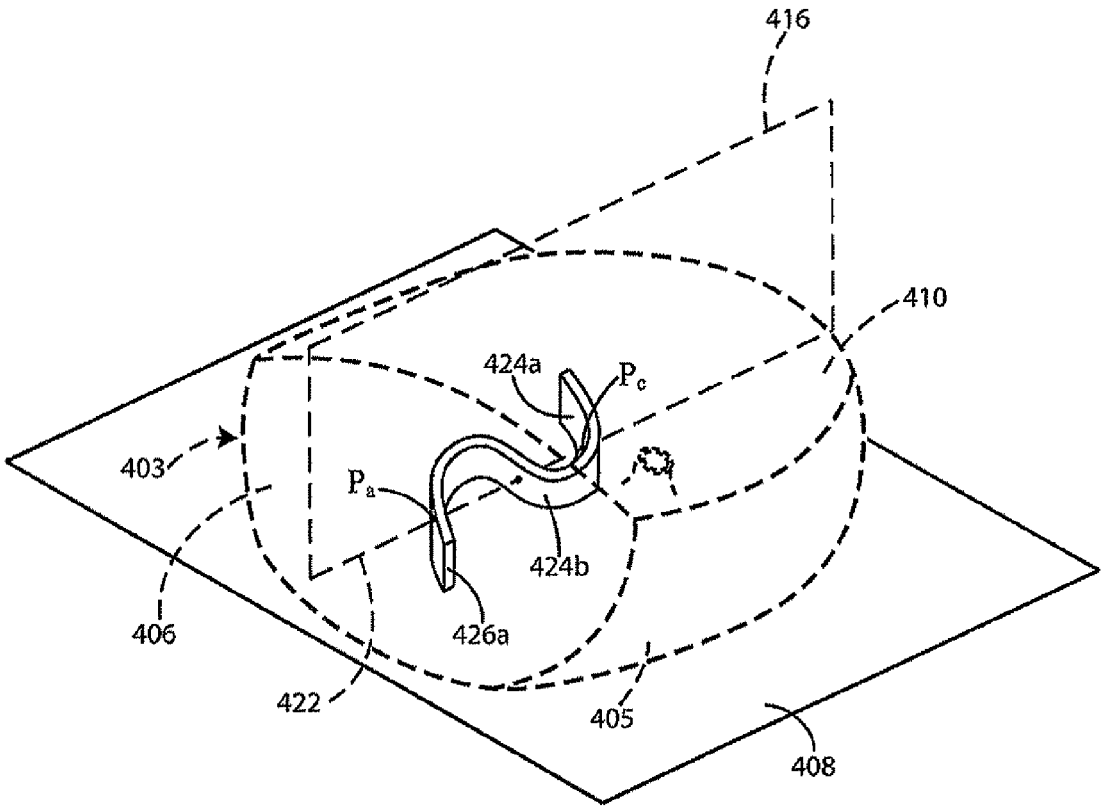
FIG. 4B is a front heel-side perspective view of the golf club head of FIG. 4.

As shown in FIGS. 4A and 4B, the stiffening element 418 may be oriented such that an imaginary horizontal line 422, located in an imaginary vertical plane 416 (FIG. 4B) that is substantially perpendicular to the plane 404, intersects one of the side surfaces 424*a* and 424*b* at at least three discrete points. For example, the horizontal line 422 may intersect the side surface 424*a* at points $P_a$, $P_b$, and $P_c$. The end surfaces 426*a* and 426*b* may be located proximate the strike face 406 and the rear surface of the club head, respectively.

Figure 5:
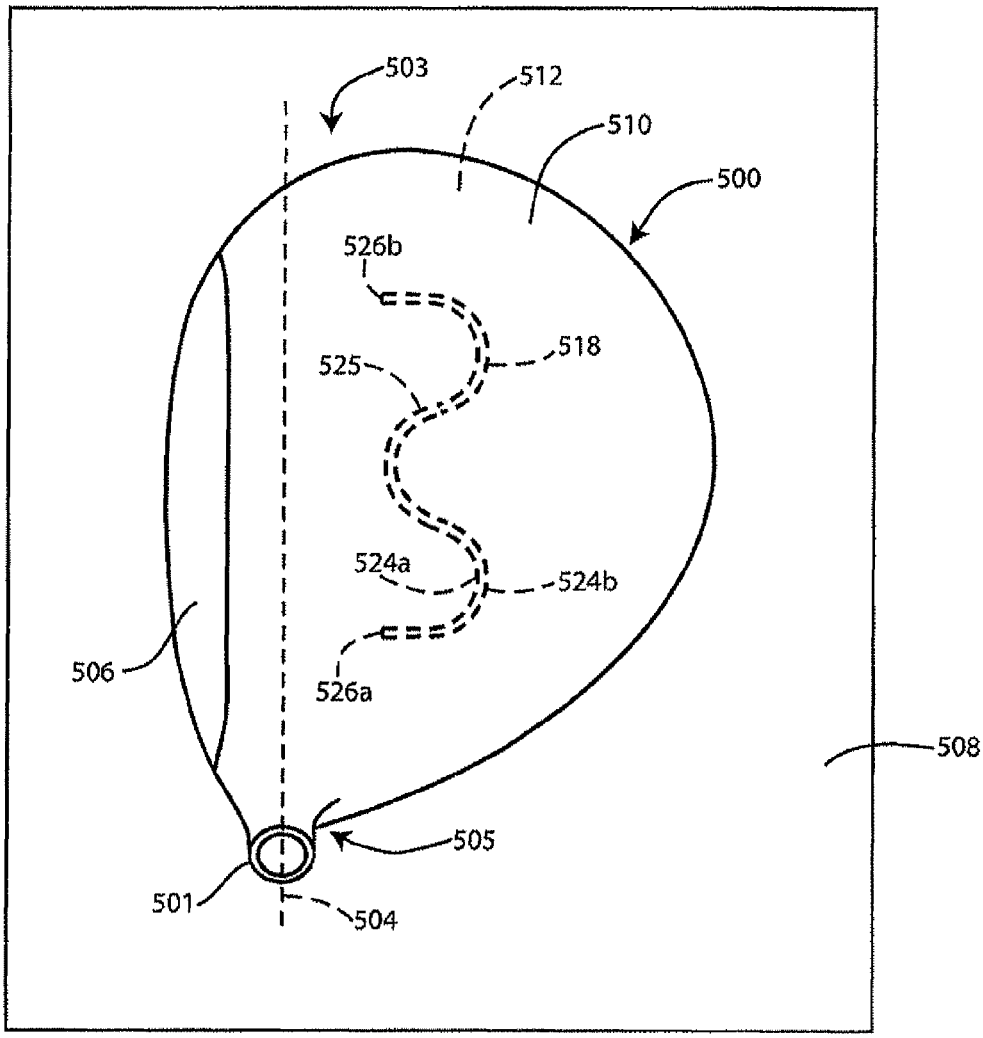
FIG. 5 is a top plan view of an exemplary golf club head according to one or more aspects of the present invention.
Figure 5A:
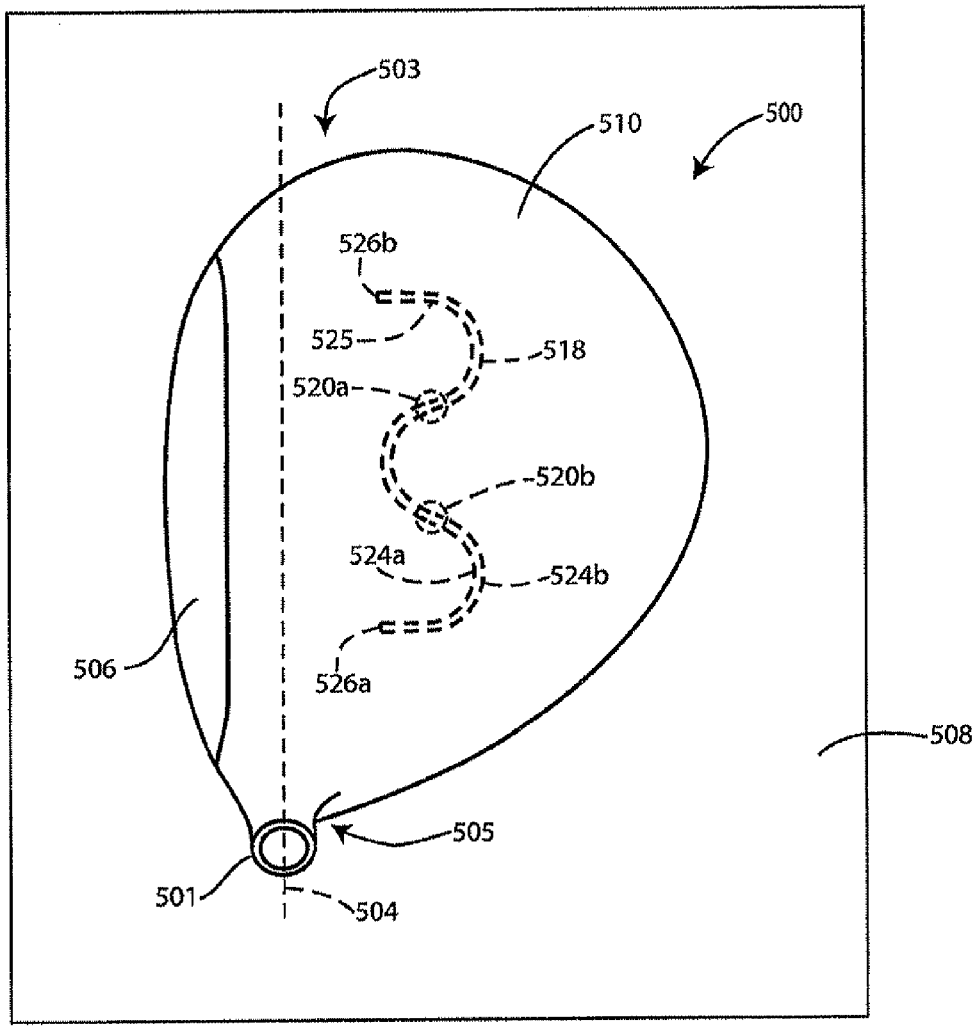
FIG. 5A is a top plan view of the golf club head of FIG. 5.

In another example, shown in FIGS. 5 and 5A, a golf club head 500, according to one or more aspects of the present invention, may generally include a strike face 506, a top portion 510, a bottom portion 512, a heel portion 505, a toe portion 503, and a hosel 501 having a central axis (not shown) located in an imaginary vertical plane 504. The club head 500 may further include a discrete stiffening element 518, having two generally vertical side surfaces 524*a* and 524*b* and two end surfaces 526*a* and 526*b*. The two side surfaces 524*a* and 524*b* may be at least partially curvilinear to reinforce unfavourably resonant areas of the club head located generally along a non-linear path 525, characterized by the vertical projection of the side surface 524*a* onto at least one of the bottom portion 512 and the top portion 510. As shown in FIG. 5A, the side surface 524*a* may have at least two inflection points, e.g., inflection points 520*a* and 520*b*, located along the non-linear path 525. The surface 524*a* may be parallel, i.e., extending in the same direction, equidistant at all points, and never converging or diverging, with the side surface 524*b*.

Figure 5B:
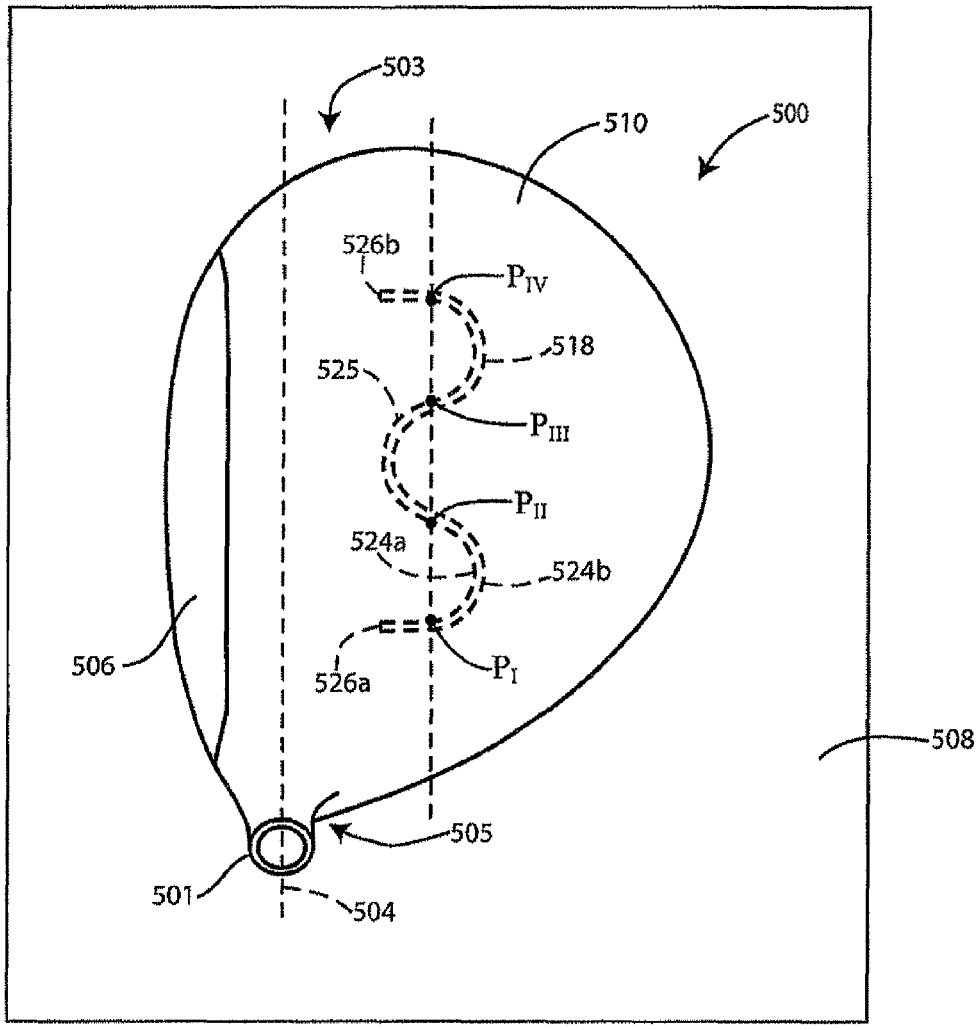
FIG. 5B is a top plan view of the golf club head of FIG. 5.
Figure 5C:
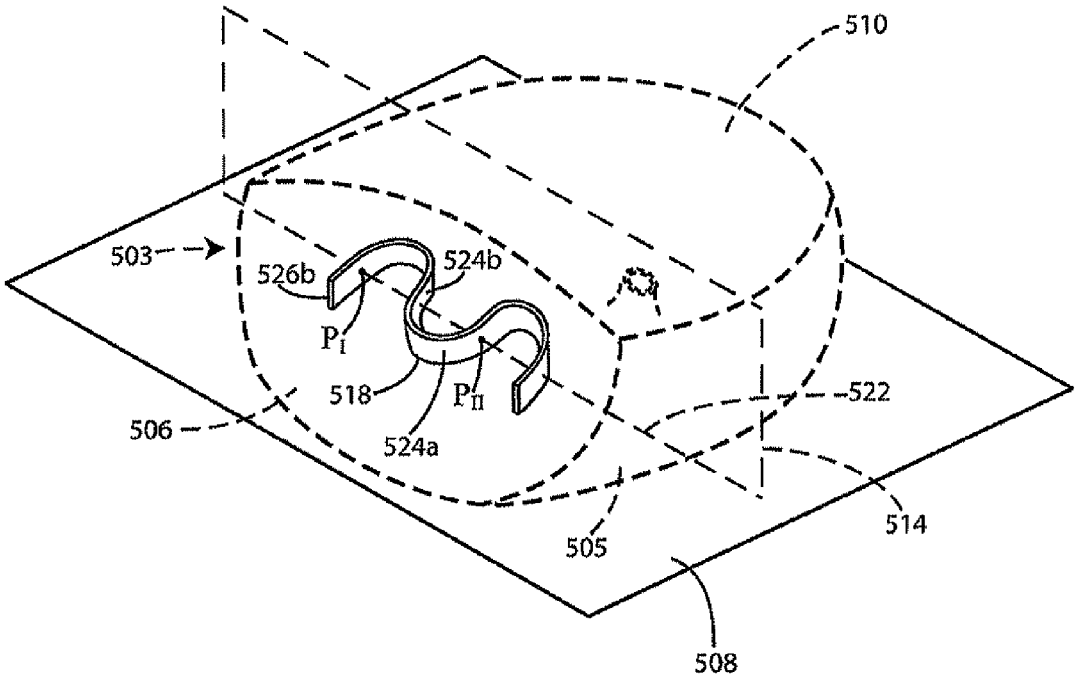
FIG. 5C is a front heel-side perspective view of the golf club head of FIG. 5.

With reference to FIGS. 5B and 5C, the stiffening element 518 may be oriented such that an imaginary horizontal line 522, located in an imaginary vertical plane 514 (FIG. 5C) that is substantially parallel to the plane 504, intersects one of the side surfaces 524*a* and 524*b* at at least four discrete points. For example, the horizontal line 522 may intersect the side surface 524*a* at points $P_I$, $P_{II}$, $P_{III}$, and $P_{IV}$. The end surfaces

526*a* and 526*b* may be located proximate the heel portion 505 and the toe portion 503, respectively.

Figure 6:
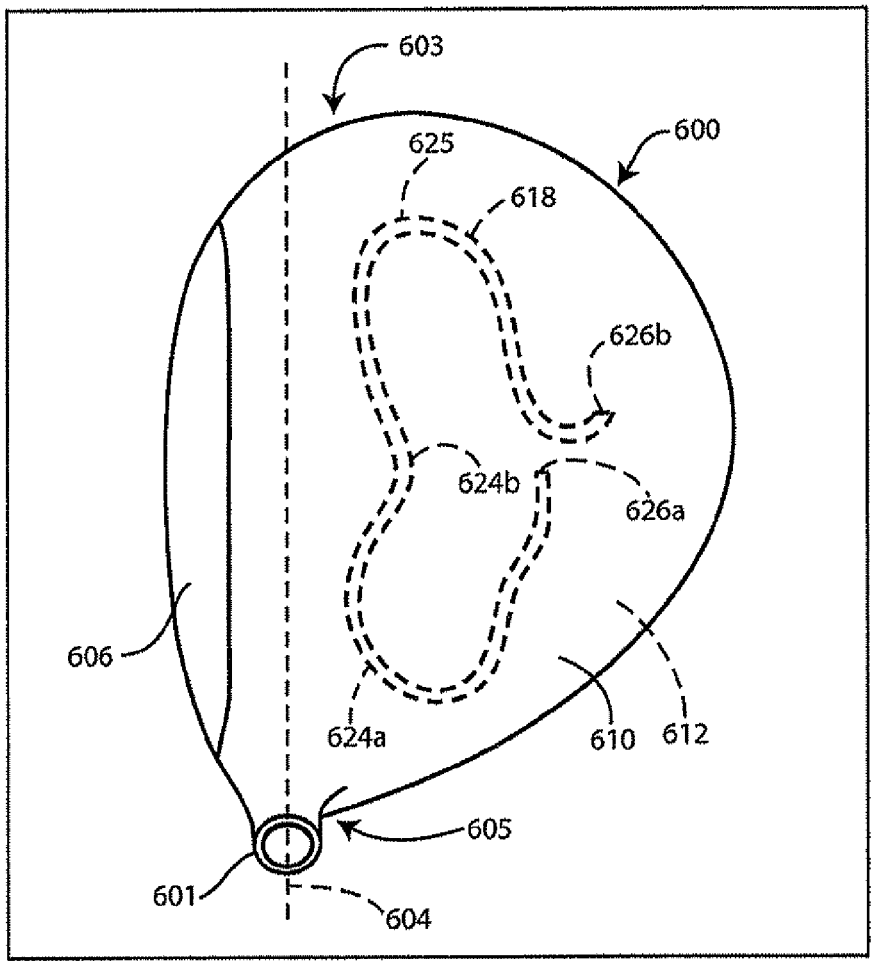
FIG. 6 is a top plan view of an exemplary golf club head according to one or more aspects of the present invention.
Figure 6A:
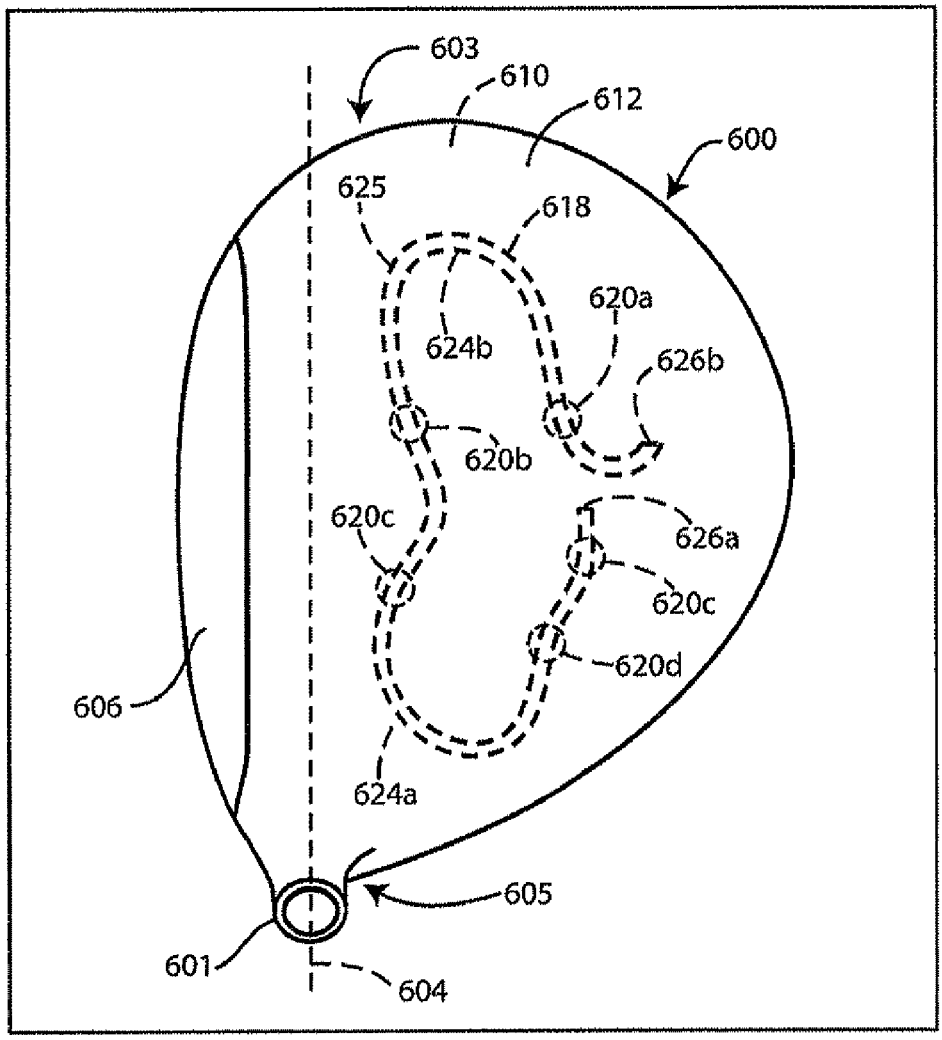
FIG. 6A is a top plan view of the golf club head of FIG. 6.

As shown in FIGS. 6 and 6A, a golf club head 600, according to one or more aspects of the present invention, may generally include a strike face 606, a top portion 610, a bottom portion 612, a heel portion 605, a toe portion 603, and a hosel 601 having a central axis (not shown) located in an imaginary vertical plane 604. To improve dynamic-excitation response, the club head 600 may further include a discrete stiffening element 618, having two generally vertical side surfaces 624*a* and 624*b* and two end surfaces 626*a* and 626*b*. The two side surfaces 624*a* and 624*b* may be at least partially curvilinear to reinforce unfavorably resonant areas of the club head located generally along a non-linear path 625, characterized by the vertical projection of the side surface 624*a* onto at least one of the bottom portion 612 and the top portion 610. As shown in FIG. 6A, the side surface 624*a* may have at least three inflection points, e.g., inflection points 620*a*-620*e*, located along the nonlinear path 625, and may be parallel, i.e., extending in the same direction, equidistant at all points, and never converging or diverging, with the side surface 624*b*.

Figure 6B:
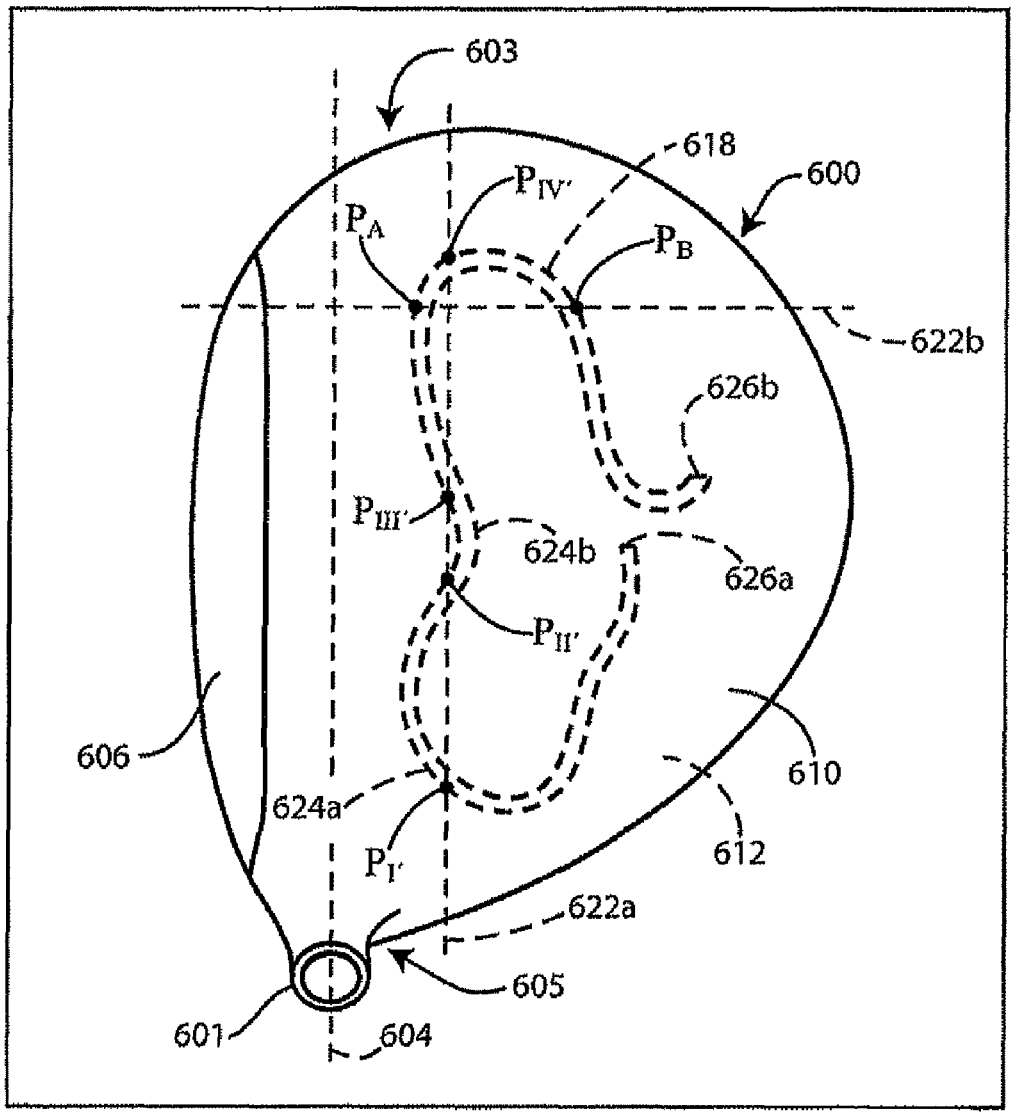
FIG. 6B is a top plan view of the golf club head of FIG. 6.
Figure 6C:
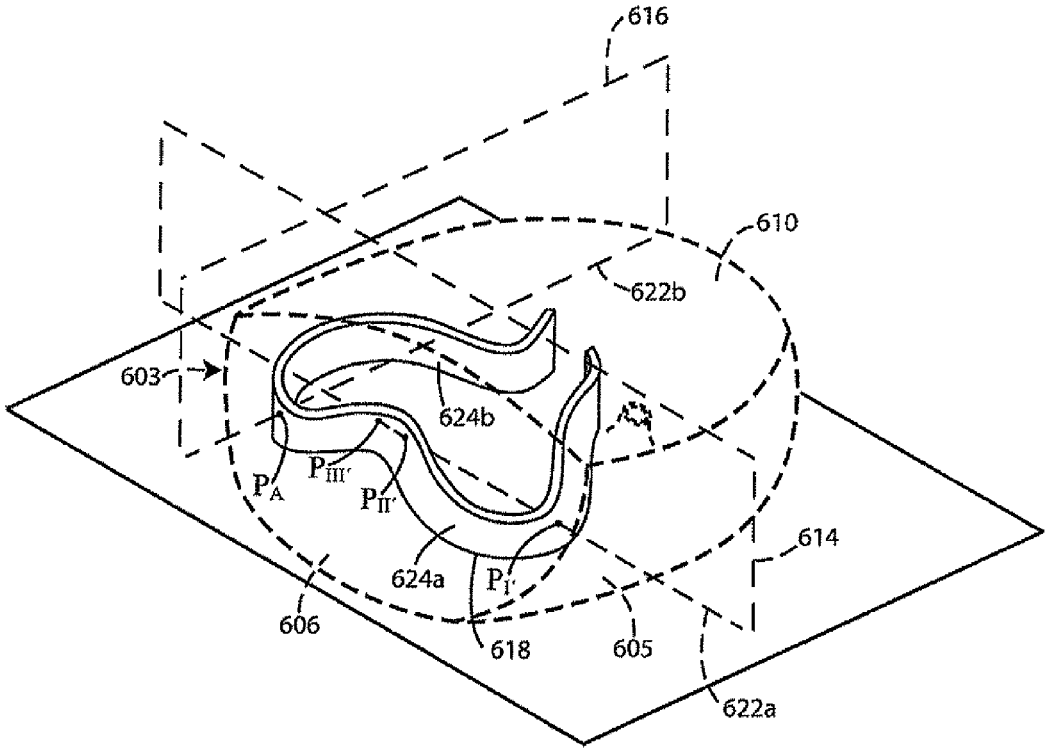
FIG. 6C is a front heel-side perspective view of the golf club head of FIG. 6.

Referring to FIGS. 6B and 6C, the stiffening element 618 may be oriented such that an imaginary horizontal line 622*a*, located in an imaginary vertical plane 614 that is substantially parallel to the plane 604, intersects one of the side surfaces 624*a* and 624*b* at at least three discrete points, e.g., points $P_I$-$P_{IV}$. Moreover, the stiffening element may be positioned such that an imaginary horizontal line 622*b*, located in an imaginary vertical plane 616 that is substantially perpendicular to the plane 604, intersects one of the side surfaces 624*a* and 624*b* at at least two points, e.g., points $P_A$ and $P_B$. The end surfaces 626*a* and 626*b* may be located proximate the rear portion of the club head.

Figure 7:
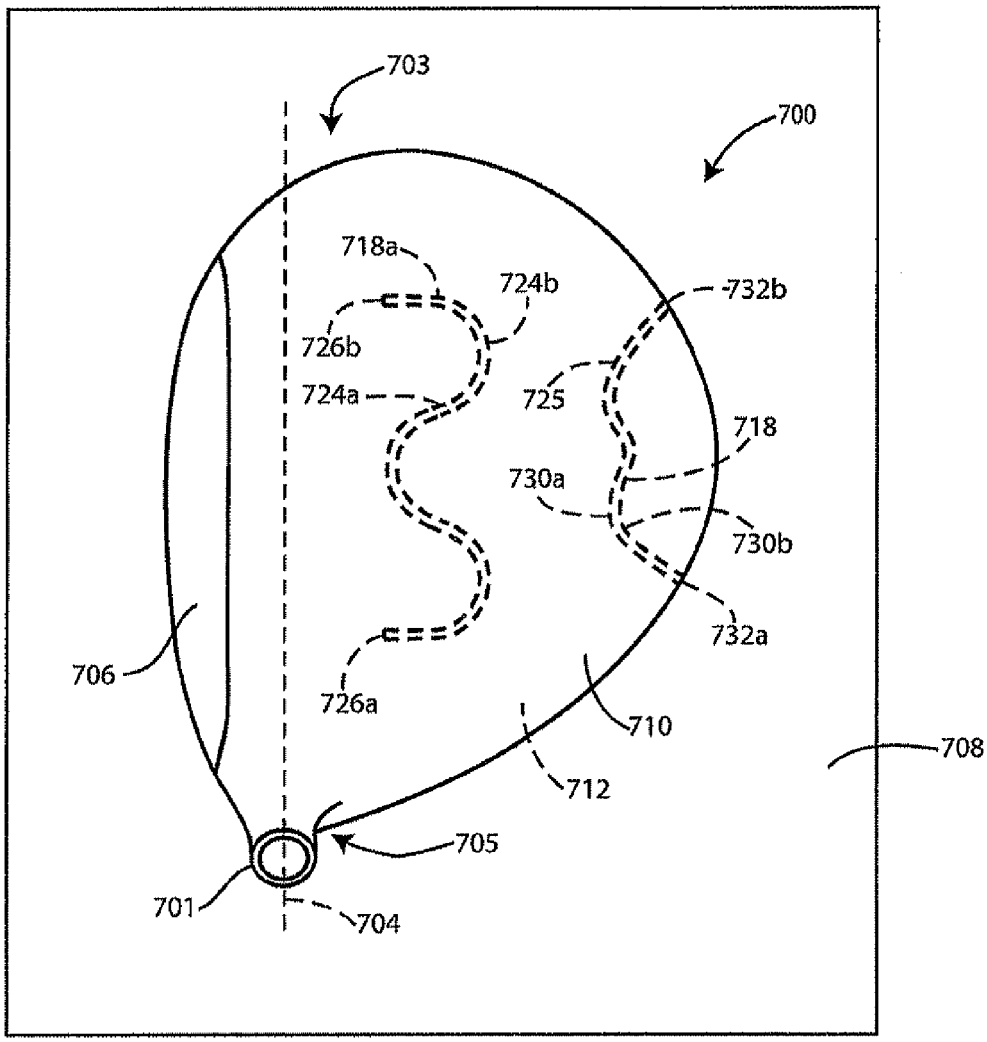
FIG. 7 is a top plan view of an exemplary golf club head according to one or more aspects of the present invention.

Referring to FIG. 7, a golf club head 700, according to one or more aspects of the present invention, may generally include a strike face 706, a top portion 710, a bottom portion 712, a heel portion 705, a toe portion 703, and a hosel 701, having a central axis (not shown) located in an imaginary vertical plane 704. To improve dynamic-excitation response, the club head 700 may further include a primary stiffening element 718*a*, formed in any of the configurations described above.

The dynamic excitation response of the club head 700 may be further enhanced by incorporating a secondary discrete stiffening element 718*b*, having two generally vertical side surfaces 730*a* and 730*b* and end surfaces 732*a* and 732*b*. The secondary stiffening element 718*b* may be at least partially curvilinear and may have at least one inflection point located along a non-linear path 725 that is characterized by a vertical projection of the side surface 730*a* onto at least one of the bottom portion 712 and the top portion 710. The secondary stiffening element 718*b* may be coupled to at least one of the top portion 710 and the bottom portion 712. Alternatively, the club head 703 may comprise discrete secondary stiffening elements coupled to the top portion 710 and the bottom portion 712.

A club head having a favorable dominant resonant frequency of vibration is realized through the use of one or more advantageously oriented stiffening elements. The dominant resonant frequency of vibration is the frequency that produces the greatest sound energy. Generally, the first resonant frequency of vibration is the dominant resonant frequency. Preferably, the first resonant frequency of vibration may be greater than about 1800 Hz, more preferably greater than about 2500 Hz, and most preferably greater than about 3000 Hz.

The thickness dimension of a stiffening element, according to one or more aspects of the present invention, may vary between about 0.1 mm and about 4 mm, preferably between about 0.2 mm and about 2 mm, and more preferably between about 0.4 mm and 1.5 mm. The vertical dimensions of the stiffening element may vary, e.g., between about 1 mm and about 25 mm, preferably between about 3 mm and about 20 mm, more preferably between about 4 mm and about 15 mm, and most preferably between about 5 mm and about 10 mm.

Figure 8:
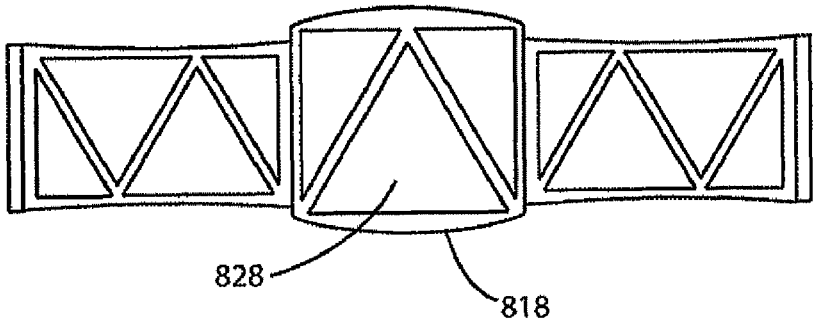
FIG. 8 is a front elevational view of an exemplary stiffening element according to one or more aspects of the present invention.
Figure 9:
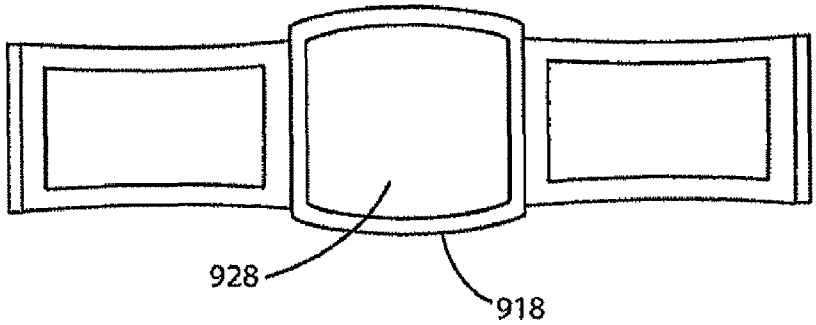
FIG. 9 is a front elevational view of an exemplary stiffening element according to one or more aspects of the present invention.

Referring to FIG. 8, a discrete stiffening element 818, according to one or more aspects of the present invention, may comprise one or more through openings 828 thus promoting a beneficial increase in the discretionary mass of the club head, while maintaining the necessary structural rigidity. As illustrated in FIG. 8, the openings may have a triangular shape. Alternatively, a stiffening element 918 (FIG. 9) may have a plurality of rectangular-shaped openings 928. Openings having other shapes, e.g., circular, oval, or irregular may also be utilized.

In the foregoing specification, the invention has been described with reference to specific examples thereof. It will, however, be evident that various modifications and changes may be made thereto without departing from the broader spirit and scope of the invention, as set forth in the appended claims. The specification and drawings are, accordingly, to be regarded in an illustrative rather than a restrictive sense.

What is claimed is:

1. A golf club head comprising:
a strike face;
a toe portion;
a heel portion;
a top portion coupled to the strike face;
a bottom portion coupled to the strike face; and
a discrete stiffening element coupled to at least one of the top portion and the bottom portion, the discrete stiffening element comprising at least three inflection points and generally vertical side surfaces, the discrete stiffening element being at least partially curvilinear.

2. A golf club head comprising:
a strike face;
a toe portion;
a heel portion;
a top portion coupled to the strike face;
a bottom portion coupled to the strike face;
a discrete stiffening element coupled to at least one of the top portion and the bottom portion, the discrete stiffening element comprising at least two inflection points and generally vertical side surfaces, the discrete stiffening element being at least partially curvilinear;
a hosel coupled to the top portion, the hosel having a central axis;
a first imaginary vertical plane containing the central axis;
a second imaginary vertical plane oriented substantially parallel to the first imaginary vertical plane; and
an imaginary horizontal line disposed in the second imaginary vertical plane, the imaginary horizontal line intersecting one of the generally vertical side surfaces at at least three discrete points.

3. The golf club head of claim 2, wherein the imaginary horizontal line intersects one of the generally vertical side surfaces at at least four discrete points.

4. A golf club head comprising:
a strike face;
a toe portion;
a heel portion;
a top portion coupled to the strike face;
a bottom portion coupled to the strike face;

a discrete stiffening element coupled to at least one of the top portion and the bottom portion, the discrete stiffening element comprising at least two inflection points and generally vertical side surfaces, the discrete stiffening element being at least partially curvilinear;

a hosel coupled to the top portion, the hosel having a central axis;

a first imaginary vertical plane containing the central axis;

a second imaginary vertical plane oriented substantially perpendicular to the first imaginary vertical plane; and an imaginary horizontal line disposed in the second imaginary vertical plane, the imaginary horizontal line intersecting one of the generally vertical side surfaces at at least two discrete points.

5. The golf club head of claim 4, wherein the imaginary horizontal line intersects one of the generally vertical side surfaces at at least three discrete points.

6. The golf club head of claim 5, wherein the imaginary horizontal line intersects one of the generally vertical side surfaces at at least four discrete points.

7. A golf club head comprising:

a strike face;

a toe portion;

a heel portion;

a top portion coupled to the strike face;

a bottom portion coupled to the strike face;

a discrete stiffening element coupled to at least one of the top portion and the bottom portion, the discrete stiffening element comprising at least two inflection points and generally vertical side surfaces, the discrete stiffening element being at least partially curvilinear; and a second discrete stiffening element comprising generally vertical side surfaces, the second discrete stiffening element being at least partially curvilinear.

8. The golf club head of claim 7, wherein the second discrete stiffening element is coupled to at least one of the top portion and the bottom portion.

9. A golf club head comprising:

a strike face;

a top portion coupled to the strike face;

a hosel associated with the top portion, the hosel having a central axis;

a bottom portion coupled to the strike face;

a discrete stiffening element coupled to at least one of the top portion and the bottom portion, the discrete stiffening element comprising generally vertical side surfaces, the discrete stiffening element being at least partially curvilinear;

a first imaginary vertical plane containing the central axis;

a second imaginary vertical plane oriented substantially parallel to the first imaginary vertical plane; and an imaginary horizontal line disposed in the second imaginary vertical plane, the imaginary horizontal line intersecting one of the generally vertical side surfaces at at least four discrete points.

10. The golf club head of claim 9, wherein the discrete stiffening element is coupled to the top portion and the bottom portion.

11. The golf club head of claim 9, wherein the discrete stiffening element further comprises at least one through opening therein.

12. The golf club head of claim 9 further comprising a second discrete stiffening element comprising generally vertical side surfaces, the second discrete stiffening element being at least partially curvilinear.

13. The golf club head of claim 12, wherein the second discrete stiffening element is coupled to at least one of the top portion and the bottom portion.

14. A golf club head comprising:

a strike face;

a heel portion;

a toe portion;

a top portion coupled to the strike face;

a bottom portion coupled to the strike face;

a hosel associated with the top portion, the hosel having a central axis;

a discrete stiffening element coupled to at least one of the top portion and the bottom portion, the discrete stiffening element comprising at least one inflection point and generally vertical side surfaces, the discrete stiffening element being at least partially curvilinear;

a first imaginary vertical plane containing the central axis;

a second imaginary vertical plane oriented substantially perpendicular to the first imaginary vertical plane; and an imaginary horizontal line disposed in the second imaginary vertical plane, the imaginary horizontal line intersecting one of the generally vertical side surfaces at at least two discrete points.

15. The golf club head of claim 14, wherein the imaginary horizontal line intersects one of the generally vertical side surfaces at at least three discrete points.

16. The golf club head of claim 15, wherein the imaginary horizontal line intersects one of the generally vertical side surfaces at at least four discrete points.

17. The golf club head of claim 14, wherein the discrete stiffening element is coupled to at least one of the top portion and the bottom portion.

18. The golf club head of claim 17 further comprising a dominant resonant frequency of vibration greater than about 2500 Hz.

19. The golf club head of claim 14, wherein the discrete stiffening element further comprises at least one through opening.

20. The golf club head of claim 14 further comprising a second discrete stiffening element comprising generally vertical surfaces, the second discrete stiffening element being at least partially curvilinear.

21. The golf club head of claim 20, wherein the second discrete stiffening element is coupled to at least one of the top portion and the bottom portion.

* * * * *